US005819440A

United States Patent [19]

Okajima

[11] Patent Number: 5,819,440

[45] Date of Patent: Oct. 13, 1998

[54] BACK SUPPORT FOR A SNOWBOARD BOOT

[75] Inventor: Shinpei Okajima, Izumi, Japan

[73] Assignee: Shimano, Inc., Osaka, Japan

[21] Appl. No.: 781,799

[22] Filed: Jan. 10, 1997

[30] Foreign Application Priority Data

Jan. 26, 1996 [JP] Japan ..... 8-032795

[51] Int. Cl.[6] ..... A43B 5/04; A43B 5/16

[52] U.S. Cl. ..... 36/117.1; 36/88; 36/115

[58] Field of Search ..... 36/117.1, 118.2, 36/118.3, 118.4, 118.5, 118.6, 118.7, 118.8, 118.9, 119.1, 115, 88, 89, 92, 69

[56] References Cited

U.S. PATENT DOCUMENTS

| | | | |
|---|---|---|---|
| 1,090,106 | 3/1914 | Montine | 36/69 |
| 2,261,453 | 11/1941 | Reinhart et al. | 36/89 |
| 3,597,862 | 8/1971 | Vogel | 36/2.5 |
| 3,807,062 | 4/1974 | Spier | 36/2.5 AL |
| 4,506,460 | 3/1985 | Rudy | 36/69 |
| 4,835,885 | 6/1989 | Hoshizaki et al. | 36/115 |
| 5,408,761 | 4/1995 | Gazzano | 36/88 |
| 5,435,080 | 7/1995 | Meiselman | 36/115 |
| 5,636,455 | 6/1997 | Meiselman | 36/88 |

*Primary Examiner*—M. D. Patterson
*Attorney, Agent, or Firm*—James A. Deland

[57] ABSTRACT

A back support for a snowboard boot includes a heel portion and an upper portion. The heel portion includes a left heel side portion, a right heel side portion, and a heel curved portion that curves as it connects the left heel side portion and the right heel side portion. The upper portion is coupled to the heel portion above the heel portion, and a rear portion of an upper end of the upper portion is formed as a flexible portion. The rear portion of the upper end of the upper portion may be rendered flexible by its shape and/or combination of materials.

16 Claims, 4 Drawing Sheets

BACK SUPPORT FOR A SNOWBOARD BOOT

BACKGROUND OF THE INVENTION

The present invention is directed to snowboard boots and, more particularly, to a back support for a snowboard boot that pliantly conforms to the front and rear inclination of the leg during snowboard use.

A snowboard boot that is fixed to a snowboard via an engagement mechanism has the ability to securely fix the attitude of the leg with respect to the snowboard during movement. Since snowboards are ridden sideways, leg strength is required to incline the ankle forward. To meet this need, the inventor has previously developed snowboard boots constructed such that the leg of the boot may be inclined forward with laces or other structures. Improved heel cups also have been developed to help incline the ankle forward. One improved heel cup comprises an upper extension portion that extends above the conventional heel cup. Another improved heel cup includes a separate back support that extends along the heel cup and above the heel cup.

Providing modified heel cups make the boot more rigid. However, if the boot becomes too rigid, then the ankle can become fatigued and begin to hurt as a result of the pressure it receives on its rear surface from the structural members. Thus, there is a need for a snowboard boot that has a structure that aids in the forward inclination of the ankle and simultaneously reduces ankle fatigue. There is also a need for a lateral structure that pliantly aids the lateral force along with the forward inclination structure.

SUMMARY OF THE INVENTION

The present invention is directed to a back support for a snowboard boot which aids the forward inclination function while simultaneously reducing fatigue. This is accomplished by varying the shape or materials of the back support to provide increased flexibility of the back support while still enhancing the forward and/or lateral inclination function of the snowboard boot.

In one embodiment of the present invention, a back support for a snowboard boot includes a heel portion and an upper portion. The heel portion includes a left heel side portion, a right heel side portion and a heel curved portion that curves as it connects the left heel side portion and the right heel side portion. The upper portion is coupled to the heel portion above the heel portion, and a rear portion of an upper end of the upper portion is formed as a flexible portion. The rear portion of the upper end of the upper portion may be rendered flexible by its shape and/or combination of materials. For example, the rear portion of the upper end of the upper portion may a discontinuity in material in a horizontal direction between a left upper side portion and a right upper side portion thereof. The discontinuity of material may be formed by one or more spaces defined by the rear portion of the upper end of the upper portion, such as where the rear portion of the upper end of the upper portion has a corrugated shape, or else it may be formed by alternating the type of material used to form the rear portion of the upper end of the upper portion.

With the back support for a snowboard boot of the present invention, the flexibility of the upper portion located above the heel portion is imparted in the front and rear directions. Since the portion that pushes on the ankle in forward inclination is flexible, the upper portion of the back support pushes the ankle softly in the forward inclination direction. The ankle receives pressure that is more evenly distributed as it periodically performs repeated movement in the front and rear directions. Because the force repeatedly received by the ankle has less powerful impact force, fatigue of the ankle is reduced and pain is alleviated even when the boot is used for extended periods.

The upper portion of the back support may be equipped with side portions that extend forward. As a result, the leg of the rider is supported from both sides of the upper portion of the back support. Therefore, a leg that is undergoing precession is supported by the back support from all directions. However, the side portions of the upper portion are also flexible in the lateral direction because the front ends are free. If desired, the back support may be provided with an elongated middle portion between the heel portion and the upper portion. This elongated middle portion readily inclines in the front and rear directions to further aid the inclination function.

DETAILED DESCRIPTION OF THE EMBODIMENTS

Figure 1:
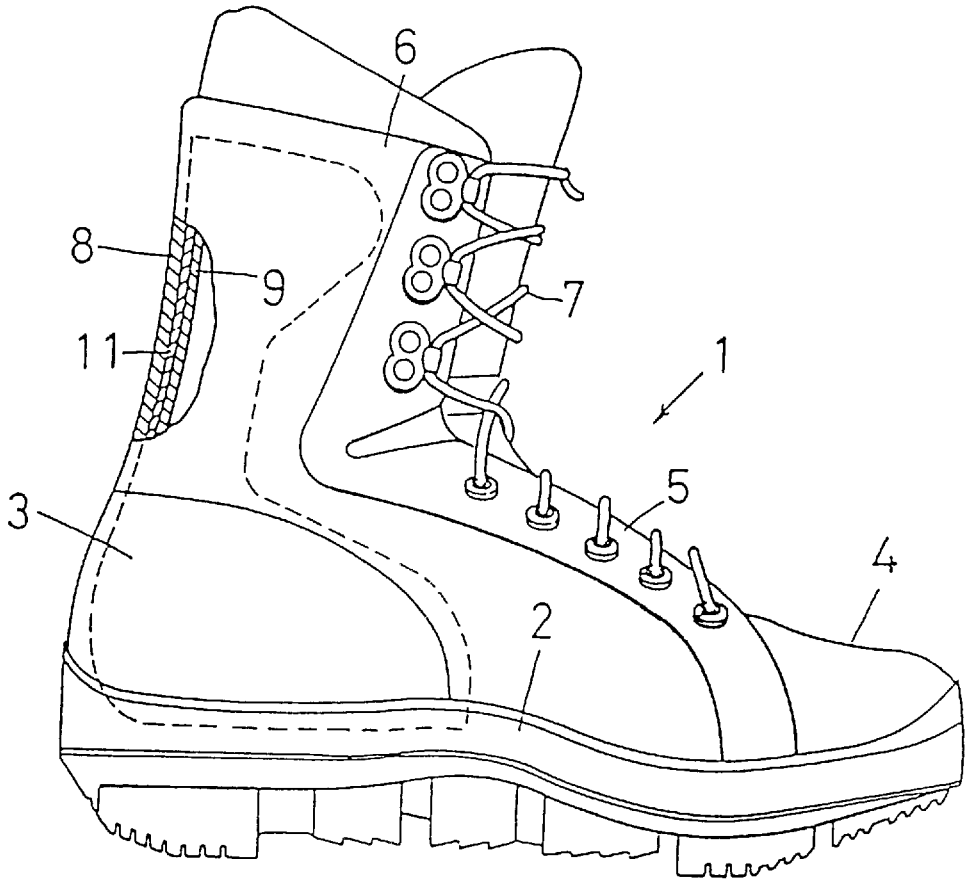
FIG. 1 is a side view of a particular embodiment of a snowboard boot according to the present invention.

FIG. 1 is a side view of a particular embodiment of a snowboard boot according to the present invention. As shown in FIG. 1, a snowboard boot 1 is made up of a sole 2, a heel 3, a toe 4, an upper 5, and a cylindrical leg component 6 that is connected above the heel 3 and the upper 5. The underside of the sole 2 is formed in a concave shape. A boot engagement mechanism is mounted to the concavity on the underside of the sole 2, but this mechanism is not shown in the figures. This boot engagement mechanism detachably engages with the engagement mechanism on the board side.

The foot can be securely fixed within the snowboard boot 1 by means of laces, but the snowboard boot 1 provides a certain amount of flexibility. The angle between the upper 5 and the leg component 6 can be adjusted by tightening or loosening the laces 7. Other mechanisms for adjusting the angle between the upper 5 and the leg component 6 have been developed by the inventor, and those may be employed as well.

As seen in the partial cross section in FIG. 1, the heel and the leg component 6 are formed in a three-layer construction. The outer layer 8 is facing leather, while the inner layer 9 is lining leather. The middle layer is the snowboard boot back support 11 of the present invention and, in this embodiment, the lower end of the back support 11 reaches the sole 2. In addition to the inner and outer layers 8 and 9 and the middle layer, a heel cup can be inserted into the heel 3. This heel cup can be inserted as a fourth layer between the inner layer and the back support 11 that serves as the middle layer. No heel cup is inserted in this embodiment.

Figure 2:
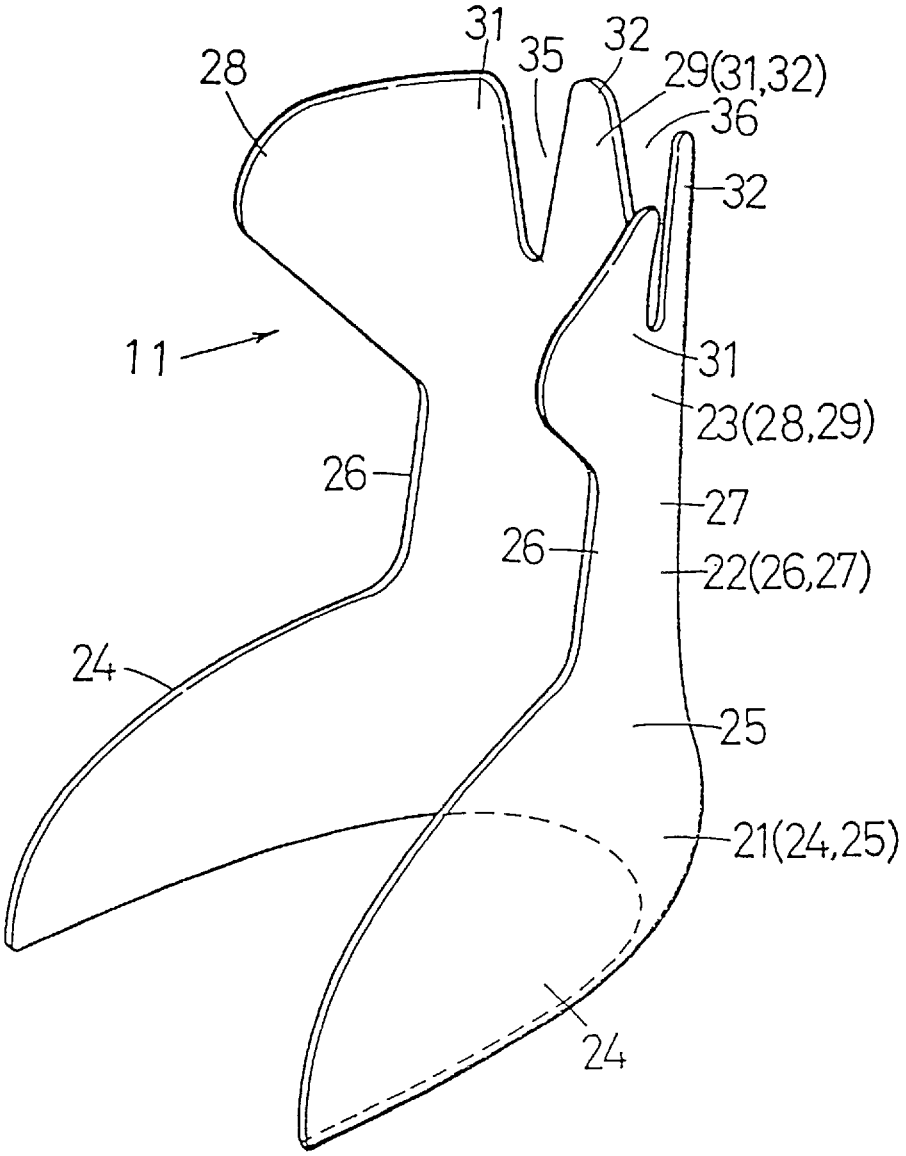
FIG. 2 is an oblique view of a particular embodiment of a back support for the snowboard boot shown in FIG. 1.
Figure 3:
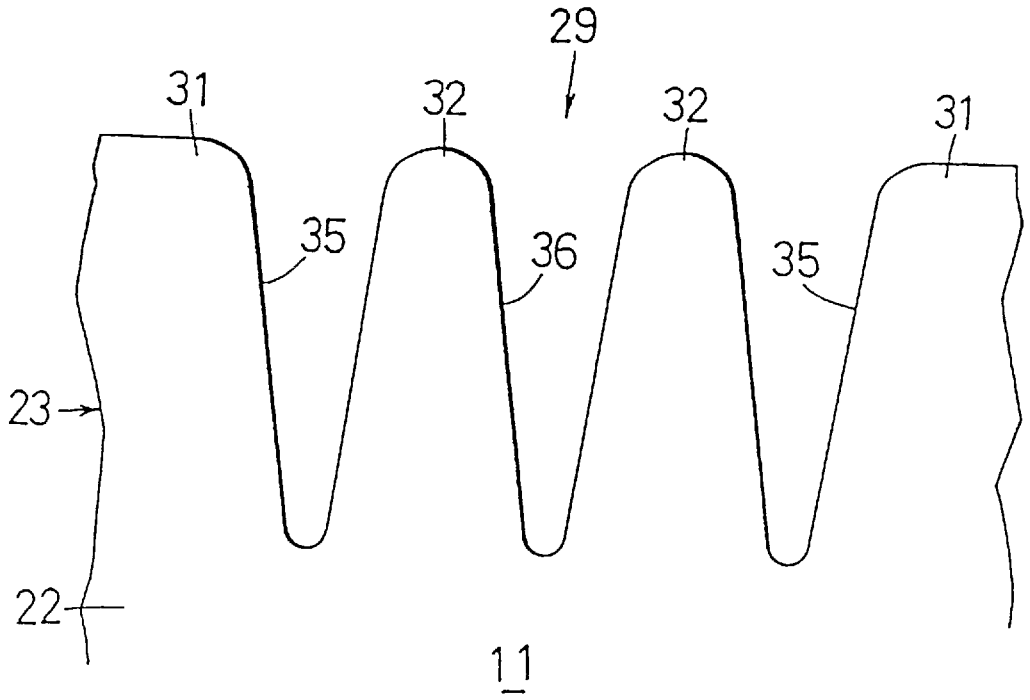
FIG. 3 is a detailed view of the rear portion of the upper end of the upper portion of the back support shown in FIG. 2.

FIG. 2 is an oblique view of a particular embodiment of the back support 11 for the snowboard boot 1 shown in FIG. 1, and FIG. 3 is a detailed view of the rear portion of the upper end of the upper portion of the back support 11. The back support 11 is made up of a heel portion 21, a middle portion 22, and an upper portion 23. In this embodiment, the middle portion 22 extends continuously upward from the heel portion 21, and the upper portion 23 extends continuously upward from the middle portion 22. The heel portion 21, the middle portion 22, and the upper portion 23 are an integrally molded article.

The heel portion 21 is equipped with heel side portions 24 on the left and right sides, and a heel curved portion 25 that curves as it connects the heel side portions 24. The middle portion 22 is made up of middle side portions 26 on the left and right sides, and a middle curved portion 27 that curves as it connects the middle side portions 26. The upper portion 23 is made up of upper side portions 28 on the left and right sides, and an upper curved portion 29 that curves as it connects the upper side portions 28.

The heel side portions 24 on the left and right sides of the heel portion 21 extend farther forward than the middle side portions 26 on the left and right sides of the middle portion 22. The upper side portions 28 on the left and right sides of the upper portion 23 extend farther forward than the middle side portions 26 on the left and right sides of the middle portion 22. The heel side portions 24 on the left and right sides of the heel portion 21 extend farther forward than the upper side portions 28 on the left and right sides of the upper portion 23.

The upper portion 23 has a more flexible construction than the heel portion 21 and the middle curved portion 27. Since the vertical width of the upper side portions 28 is greater than the vertical width of the middle side portions 26, the moment pertaining to the deformation force of the upper side portions 28 is greater than the moment pertaining to the deformation force of the middle side portions 26. In terms of spreading out to the left and right, the upper side portions 28 is more flexible than the middle side portions 26.

The upper curved portion 29, which is the rear part including the upper end of the upper portion 23, is made up of rear side portions 31 and a rear center portion 32. The upper side portion 28 on the right side is contiguous with the rear side portion 31 on the right side, and the upper side portion 28 on the left side is contiguous with the rear side portion 31 on the left side.

In this embodiment, the shape of the upper end of the upper curved portion 29 is corrugated. In other words, there are valley-like depressions between the rear center portion 32 and the rear side portions 31 on the left and right sides. In this case, the valleys 35 are formed in two places. The rear center portion 32 includes a valley 36, and it is flexible because of this shape. This flexibility is what makes the structure flexible in the front and rear directions. The structure can be changed to one that is not provided with these valleys by performing two-color integral molding in which the center is an elastomer, such as a rubber material. The flexibility of the center in this case will be dependent on the material.

The back support 11 can be produced by subjecting a plastic plate to thermal deformation. That is, a plate or sheet that is a flattened version of the three-dimensional object in FIG. 2 can be subjected to thermal deformation and rendered three-dimensional, or the three-dimensional object in FIG. 2 can be molded by injection molding.

A bottom plate can be formed by bending the lower end sides of the heel side portions 24 and extending them from the center. The back support 11 is not necessarily bonded to the outer layer 8 or inner layer 9. The back support 11 may instead merely be inserted between the outer layer 8 and the inner layer 9. In this embodiment, the back support 11 is made from a hard engineering plastic.

The rear center portion 32 of the upper curved portion 29 is flexible in the front and rear directions. The middle portion 22 has little flexibility in the front and rear directions because of the presence of the middle curved portion 27. The heel portion 21 has even less flexibility in the front and rear directions because of the presence of the heel curved portion 25. The heel portion 21 functions as a heel cup.

As for the flexibility in the front and rear directions of the upper portion 23, the tolerance pertaining to the inclination of the leg, whose approximate center axis is defined by the anklebones on either side, is higher than in other portions. The tolerance pertaining to the inclination of the leg in the left and right directions is high in the upper side portions 28. As a result of this tolerance in the front and rear directions and in the left and right directions, the precession of the leg is permitted while being limited to a certain extent. The degree of tolerance is a setting value that is dependent on the material hardness, the width and other dimensions of the rear center portion 32, the length and width of the upper side portions 28 in the front and rear directions, and so on.

Figure 4:
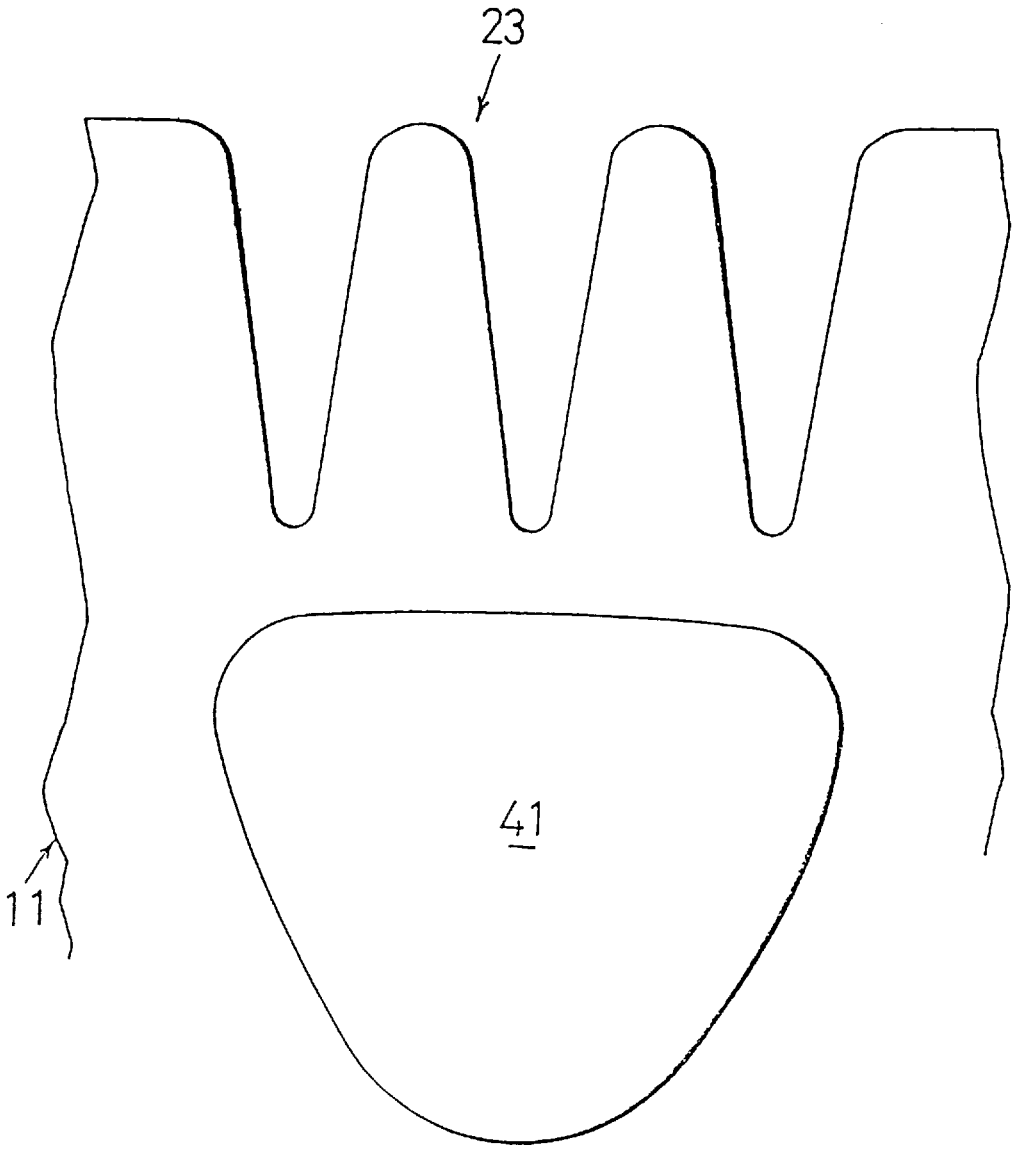
FIG. 4 is a detailed view of an alternative embodiment of a rear portion of a back support according to the present invention.

FIG. 4 is a detailed view of an alternative embodiment of a rear portion of a back support according to the present invention. In this embodiment a reinforcing plate 41 has been applied to the middle portion 22. Two plates can also be applied in the molding.

While the above is a description of various embodiments of the present invention, further modifications may be employed without departing from the spirit and scope of the present invention. For example, the valley portions can also be somewhere other than the center. A valley-like shape is not the only one that will impart flexibility, and a holed structure or a reticulated structure can also be used. Flexibility can also be achieved by a reduction in thickness.

Thus, the scope of the invention should not be limited by the specific structures disclosed. Instead, the true scope of the invention should be determined by the following claims.

What is claimed is:

1. A molded plastic back support for a snowboard boot comprising:

a heel portion including:

a left heel side portion;

a right heel side portion;

a heel curved portion connected to the left heel side portion and to the right heel side portion, wherein the heel curved portion curves as it connects the left heel side portion and the right heel side portion;

an upper portion coupled to the heel portion above the heel portion; and wherein a rear portion of an upper end of the upper portion has a discontinuity in material along a top horizontal free edge between a left upper side portion and a right upper side portion thereof.

2. The back support according to claim 1 wherein the rear portion of the upper end of the upper portion has a corrugated shape.

3. The back support according to claim 1 wherein the rear portion of the upper end of the upper portion has a plurality of the discontinuities in material in a horizontal direction between a left upper side portion and a right upper side portion thereof.

4. The back support according to claim 3 wherein the plurality of discontinuities are formed by a plurality of spaces defined by the rear portion of the upper end of the upper portion.

5. The back support according to claim 1 further comprising an elongated middle portion connected between the heel portion and the upper portion.

6. A molded plastic back support for a snowboard boot comprising:

a heel portion including:

a left heel side portion;

a right heel side portion;

a heel curved portion connected to the left heel side portion and to the right heel side portion, wherein the heel curved portion curves as it connects the left heel side portion and the right heel side portion;

an elongated middle portion coupled to the heel portion above the heel portion;

an upper portion coupled to the middle portion above the middle portion;

wherein a rear portion of an upper end of the upper portion has a discontinuity in material along a top horizontal free edge between a left upper side portion and a right upper side portion thereof; and wherein the left heel side portion and the right heel side portion extend farther forward than the middle portion.

7. The back support according to claim 6 wherein the rear portion of the upper end of the upper portion has a corrugated shape.

8. The back support according to claim 6 wherein the rear portion of the upper end of the upper portion has a plurality of the discontinuities in material in a horizontal direction between a left upper side portion and a right upper side portion thereof.

9. The back support according to claim 8 wherein the plurality of discontinuities are formed by a plurality of spaces defined by the rear portion of the upper end of the upper portion.

10. The back support according to claim 6 wherein the middle portion has an elongated shape.

11. The back support according to claim 6 wherein the rear portion of the upper end of the upper portion has a left upper side portion and a right upper side portion, wherein the left upper side portion and the right upper side portion extend farther forward than the middle portion.

12. A molded plastic back support for a snowboard boot comprising:

a heel portion including:

a left heel side portion;

a right heel side portion;

a heel curved portion connected to the left heel side portion and to the right heel side portion, wherein the heel curved portion curves as it connects the left heel side portion and the right heel side portion;

a middle portion coupled to the heel portion above the heel portion;

an upper portion coupled to the middle portion above the middle portion;

wherein a rear portion of the upper end of the upper portion has a left upper side portion and a right upper side portion, wherein the left upper side portion and the right upper side portion extend farther forward than the middle portion;

wherein the rear portion of the upper end of the upper portion has a plurality of discontinuities in material along a horizontal free edge between the left upper side portion and the right upper side portion thereof so that the rear portion of the upper end of the upper portion is formed as a flexible portion; and wherein the left heel side portion and the right heel side portion extend farther forward than the middle portion.

13. The back support according to claim 12 wherein the plurality of discontinuities are formed by a plurality of spaces defined by the rear portion of the upper end of the upper portion.

14. The back support according to claim 13 wherein the rear portion of the upper end of the upper portion has a corrugated shape.

15. The back support according to claim 14 wherein the middle portion has an elongated shape.

16. A snowboard boot comprising:

a sole in including a heel portion and a toe portion;

an upper;

a cylindrical leg component having an inner layer and an outer layer;

a molded plastic back support disposed between the inner layer and the outer layer comprising:

a heel portion including:

a left heel side portion;

a right heel side portion;

a heel curved portion connected to the left heel side portion and to the right heel side portion, wherein the heel curved portion curves as it connects the left heel side portion and the right heel side portion;

an elongated middle portion coupled to the heel portion above the heel portion;

an upper portion coupled to the middle portion above the middle portion and the upper;

wherein a rear portion of the upper end of the upper portion has a left upper side portion and a right upper side portion, wherein the left upper side portion and the right upper side portion extend farther forward than the middle portion;

wherein the rear portion of the upper end of the upper portion above the heel has a top free edge forming a corrugated shape between the left upper side portion and the right upper side portion thereof so that the rear portion of the upper end of the upper portion is formed as a flexible portion; and wherein the left heel side portion and the right heel side portion extend farther forward than the middle portion.

* * * * *